US005400835A

United States Patent [19]

Badenoch et al.

[11] Patent Number: 5,400,835

[45] Date of Patent: Mar. 28, 1995

[54] METHOD AND ASSOCIATED TOOLS FOR JOINING WIRES UNDER TENSION

[76] Inventors: Frederick W. Badenoch, Rte. 67, Box 11, Moko, Ark. 72507; Thomas E. Gaffney, 1223 Arcadian, Waukesha, Wis. 53186; Edward J. Gaffney, N26 W27293 Highway SS, Pewaukee, Wis. 53072

[21] Appl. No.: 107,338

[22] Filed: Aug. 16, 1993

Related U.S. Application Data

[63] Continuation of Ser. No. 877,669, May 1, 1992, abandoned.

[51] Int. Cl.[6] ..... B21F 15/04

[52] U.S. Cl. ..... 140/118; 140/123.5

[58] Field of Search ..... 140/52, 102.5, 117, 140/118, 123, 123.5

[56] References Cited

U.S. PATENT DOCUMENTS

| | | | |
|---|---|---|---|
| 1,044,551 | 11/1912 | Lynch | 140/102.5 |
| 1,239,061 | 9/1917 | Tangen | 140/123.5 |
| 1,581,306 | 4/1926 | Yelton | 140/123.5 |
| 2,124,416 | 7/1938 | Hadland | 140/123.5 |
| 2,399,139 | 4/1946 | Palola | 140/118 |
| 3,205,918 | 9/1965 | Jones . | |
| 3,219,316 | 11/1965 | Fried . | |
| 3,229,727 | 1/1966 | Kenlon | 140/102.5 |
| 3,655,165 | 4/1972 | Wright . | |
| 3,683,739 | 8/1972 | Garretson . | |
| 3,716,079 | 2/1973 | Marshall . | |
| 3,768,779 | 10/1973 | Garretson . | |
| 3,785,107 | 1/1974 | Garretson . | |
| 4,662,035 | 5/1987 | Hatfield . | |
| 5,080,145 | 1/1992 | Groover | 140/123.5 |

OTHER PUBLICATIONS

P. 399 of US Patent Gazette (Jul. 15, 1947) showing abstract of U.S. Pat. No. 2,423,903.

P. 39 of US Patent Gazette showing abstract of U.S. Pat. No. 1,057,508.

P. 286 of US Patent Gazette (Mar. 13, 1956) showing abstract of U.S. Pat. No. 2,737,917.

P. 1631 of US Patent Gazette (1897) showing abstract of U.S. Pat. No. 584,189.

C. H. Dana Farm Ranch Equipment brochure dated 1990–1991. (p. 12 & 13 & cover).

Nasco Farm & Ranch 1992 Catalog (p. 228 & 229 & cover page).

Dara High Tensile Fence System Installation Manual dated 1992. (Dare Products, Inc.) (Entire manual).

*Primary Examiner*—Lowell A. Larson

*Attorney, Agent, or Firm*—Ryan, Kees & Hohenfeldt

[57] ABSTRACT

A method and associated tool joins all types of parted wire fencing material. The method and tool allow one person to quickly create a permanent splice that unites the parted wire while restoring tension to the parted wire lengths. Following the method, the tension remains when the tool is released from the splice. The result is a taut splice, with no sag or slack.

9 Claims, 8 Drawing Sheets

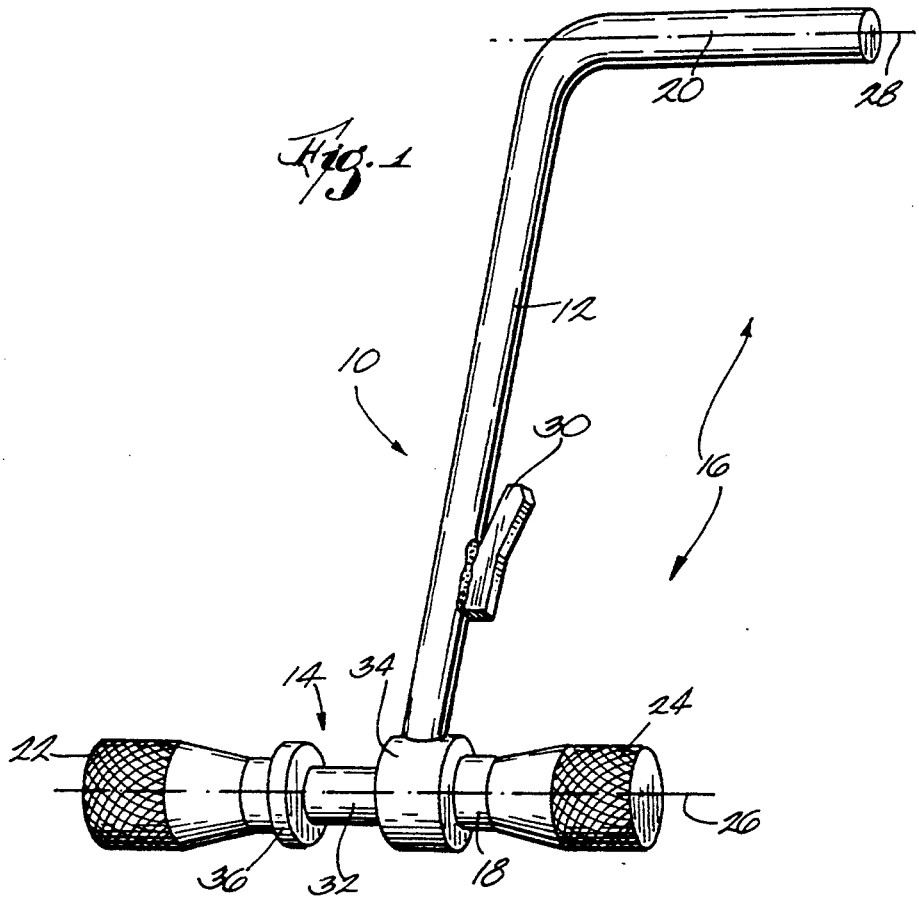
Fig. 1
Fig. 2
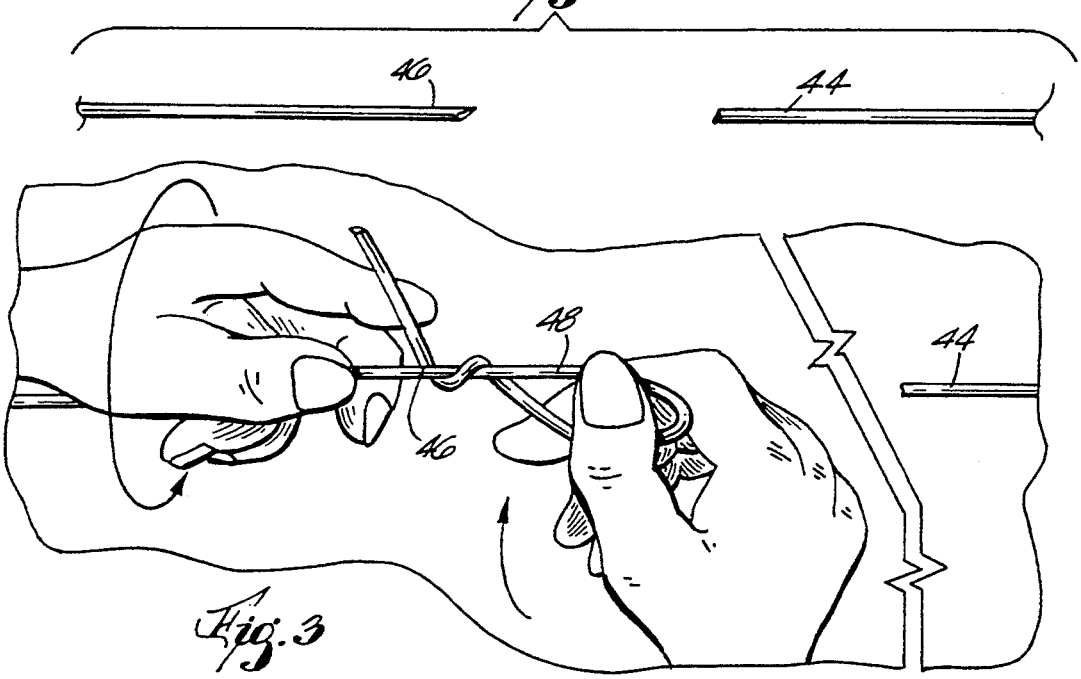
Fig. 3

10'
12'
18'
20'
22'
24'
30'
32'
34'
36'
38
40
44
54
56

METHOD AND ASSOCIATED TOOLS FOR JOINING WIRES UNDER TENSION

This is a continuation of application Ser. No. 07/877,669, filed on May 1, 1992, now abandoned.

FIELD OF THE INVENTION

The invention generally relates to tools and methods for joining lengths of wire. More particularly, the invention relates to tools and methods for mending fence wires that, in use, are held in tension.

BACKGROUND OF THE INVENTION

There are many tools and techniques for mending parted wires. Repairing fencing made of lengths of barbed wire and like material held under tension is an area where such tools and techniques are in especially high demand.

Despite the many tools and techniques, many problems persist.

One major problem lies in making a repaired fence taut or "tight." Prior tools and techniques splice parted wires back together, but the resulting splice lacks the tension of the originally strung wires. The repaired fence goes slack, and it sags. To correct this, persons resort to nailing the repaired fence wire higher on the post, or twisting the wire, or using another makeshift and often futile stopgap.

Another problem in prior tools and techniques is their lack of simplicity. Often, several individual tools must be used to make the repair. This is a considerable shortcoming, realizing that most fencing is in isolated fields and ranges. The complicated and exacting sequence required in handling multiple tools in the right way makes the user a slave to the technique, when the reverse should be true. Also, by the time the user hauls three or four tools around in the back of a pick up truck or in the tool box of a tractor for any length of time, one or more tools will most certainly be lost or damaged. The missing tool or tools then create a missing link in the repair process.

There is an unmet need for wire mending tools and techniques that use a single, sturdy tool that is nevertheless lightweight and easy to use.

There is also an unmet need for wire mending tools and techniques that perform the repair tasks with a minimum of physical effort, with little danger to the user, and little risk of damage to the tool.

There is also an unmet need for wire mending tools and techniques that result in tight, taut fencing, fully tensioned and with no sagging.

SUMMARY OF THE INVENTION

The invention provides an improved method and associated tools for mending wire that meet all these unsolved needs. The invention provides a technique and tools that splice parted wires together under tension equal to or greater than the originally strung wire.

One aspect of the invention provides a method for tensioning and joining two lengths of wire. Following the method, the user links the two lengths of wire together and connects a tool to the link. The user applies tension to the link using the tool. The user then maintains all the tension applied to the link while releasing the tool from the link. Last, the user secures the link to join the two lengths of wire at the applied tension.

In a preferred embodiment, in linking the two lengths of wire, the user forms a loop in one length of wire. The user passes a free end of the other length of wire through the loop.

To apply tension in this arrangement, the user manipulates the tool to draw the other length of wire through the loop. This pulls the two lengths of wire together and into tension.

To maintain the applied tension in this arrangement, the user doubles the wire that passes through the loop back upon itself. This bends the wire at the loop. The bend holds the wires in tension, with no slackening or sag, while the user releases the tool.

Another aspect of the invention provides a hand held tool for carrying out the method, as above described. The tool includes a splicing surface having an axis. A wire grip secures one of the lengths of wire to the splicing surface to carry out the step of connecting the tool to the link. The tool also includes a crank handle for rotating the splicing surface about its axis. This winds the secured length of wire about the splicing surface to carry out the step of applying tension to the link.

In a preferred embodiment, the tool also includes a pulling handle for pulling laterally upon the splicing surface generally across its axis. This action forms the bend at the link to carry out the step of maintaining all the tension applied to the link. With the bend formed and holding tension, the user unwinds the secured length of wire from the splice surface, thereby freeing the tool for release.

The invention joins all types of strung wire material, such as barbed wire, woven wire, hog fence, welded wire, goat fence, electrical wire, and horse fence. Using the invention, one person alone can quickly create a permanent splice that unites the parted wire. The invention applies tension to the parted wire lengths in forming the splice. The tension remains when the tool is released from the splice. The result is a taut splice, with no sag or slack.

BRIEF DESCRIPTION OF THE DRAWINGS

FIG. 1 is a perspective view of a tool for splicing wires that embodies the features of the invention;

FIGS. 2 to 16 show the use of the tool in creating a splice between two previously parted wires, employing a method that embodies the features of the invention;

DESCRIPTION OF THE PREFERRED EMBODIMENTS

Figure 4:
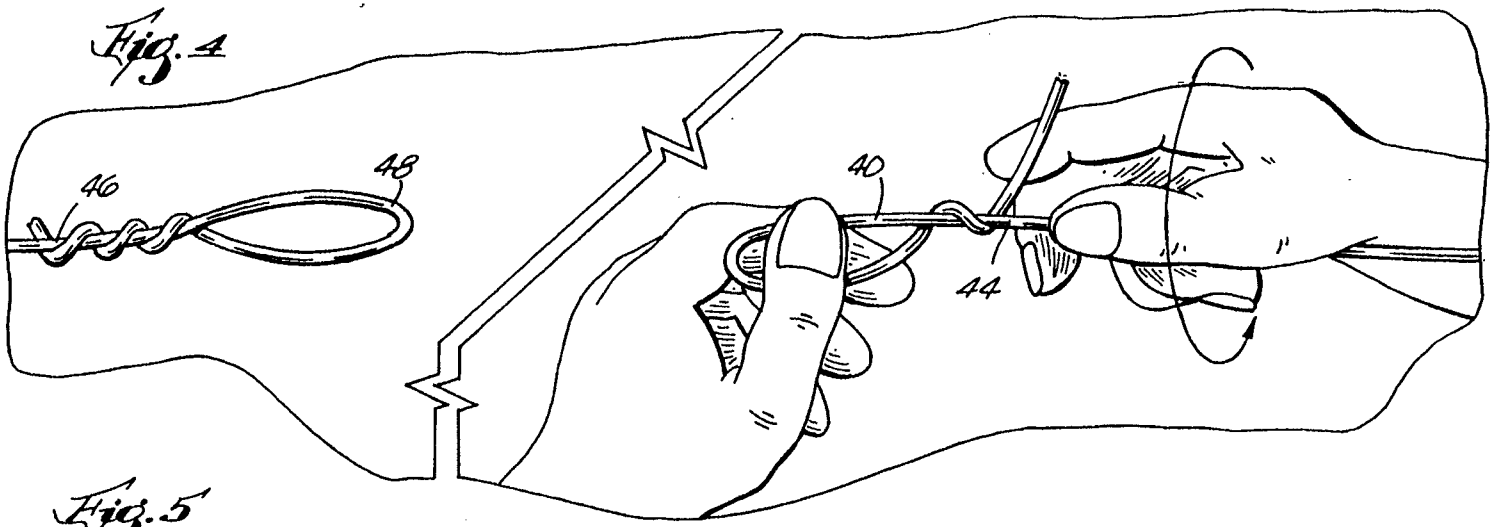

FIG. 1 shows a tool 10 that embodies the features of the invention.

The tool 10 includes a body 12 that carries a wire splicing element 14 and a handle element 16. The wire splicing element 14 and the handle element 16 can take different shapes and be positioned at different relative positions on the tool body 12.

In the embodiment shown in FIG. 1, the handle element 16 includes a pulling bar 18 and a crank 20. The pulling bar 18 extends transversely across one end of the body. The pulling bar 18 terminates with first and second oppositely spaced grips 22 and 24. The enlarged grips 22 and 24 are not essential to the function of the tool 10. Still, the grips 22 and 24 let the user more conveniently grasp and manipulate the tool 10. Preferably, the grips 22 and 24 have knurled or roughened surfaces to minimize slippage in the user's hands.

The crank 20 extends from the opposite end of the tool body 12 in the same direction as one of the pulling bar grips, which in FIG. 1 is the grip 24. In this arrangement, the axes of the pulling bar 18 and the crank 20 (respectively 26 and 28) are generally parallel. Both axes 26 and 28 extend generally at a right angle from the tool body 12.

As will be described in greater detail later, the user manipulates the tool 10 using the pulling bar 18 and the crank 20 in different ways to perform different functions during a wire splicing operation.

The wire splicing element includes a wire gripping surface 30 and a wire wrapping or splicing surface 32.

In the embodiment shown in FIG. 1, the wire gripping surface 30 comprises a cleat located between the pulling bar 18 and the crank 20. As FIG. 1 shows, the cleat 30 is preferably positioned closer to the pulling bar 18 than to the crank 20. The cleat 30 also presents itself to the user from the same side of the tool body as the crank 20 and the grip 24.

In this arrangement, a portion of the pulling bar 18 itself comprises the wire wrapping surface 32. Two collars 34 and 36 define the ends the wrapping surface 32. The first collar 34 is formed at the junction of the pulling bar 18 with the tool body 12. The second collar 36 is formed between the first collar 34 and the bar grip 22 that faces away from the crank 20. The wrapping surface. 32 extends between the two collars for rotation about the pulling bar axis 26.

The tool body 12 can be made of various materials and in various ways. In one embodiment, the body 12 is made of rolled steel stock. It is about 8.5 inches in overall length. The pulling bar 18 is also made of forged steel material and is about 5.75 inches in overall length and 11/16 inch in diameter. The crank, also made of steel stock, is about 4 inches long and 0.75 inch in diameter. The grips 22 and 24 are about 1.75 inch in maximum diameter. The cleat 30 is steel and is welded to the body 12.

FIGS. 3 to 15 show the method of splicing together a parted length of fence wire using the tool 10 shown in FIG. 1.

To summarize the steps in the method, the user links the two lengths of wire together. The user then connects a tool to the link. The user manipulates the tool to apply tension to the link.

The user then maintains all the tension applied to the link while releasing the tool from the link. Last, the user secures the link to join the two lengths of wire at the applied tension.

In the particular embodiments shown, the user employs an intermediate splice wire 38 to join the first and second lengths of parted wire. This is because the drawings assume that the first and second lengths of wire are each strung on fence supports. The splice wire 38 bridges the gap between the previously tensioned (and now parted) wires to simplify the mending process. Still, if the wires to be joined are not prestrung on fencing, or are not otherwise separated by a large gap, no intermediate splice wire 38 need be employed.

Figure 6:
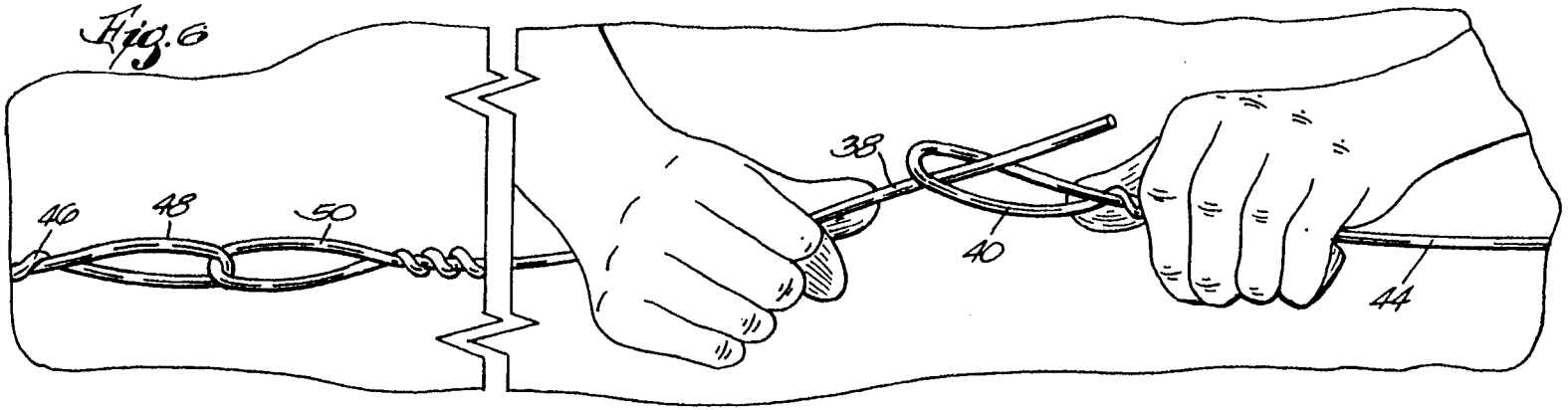

As FIG. 6 generally shows, the user attaches one end of the splice wire 38 to the first length of wire. The splice wire 38 thus becomes an extension of the first length of wire. The user forms a loop 40 in the second length of wire, and passes the other free end of the splice wire 38 through the loop 40. This links the parted wires together.

Figure 7:
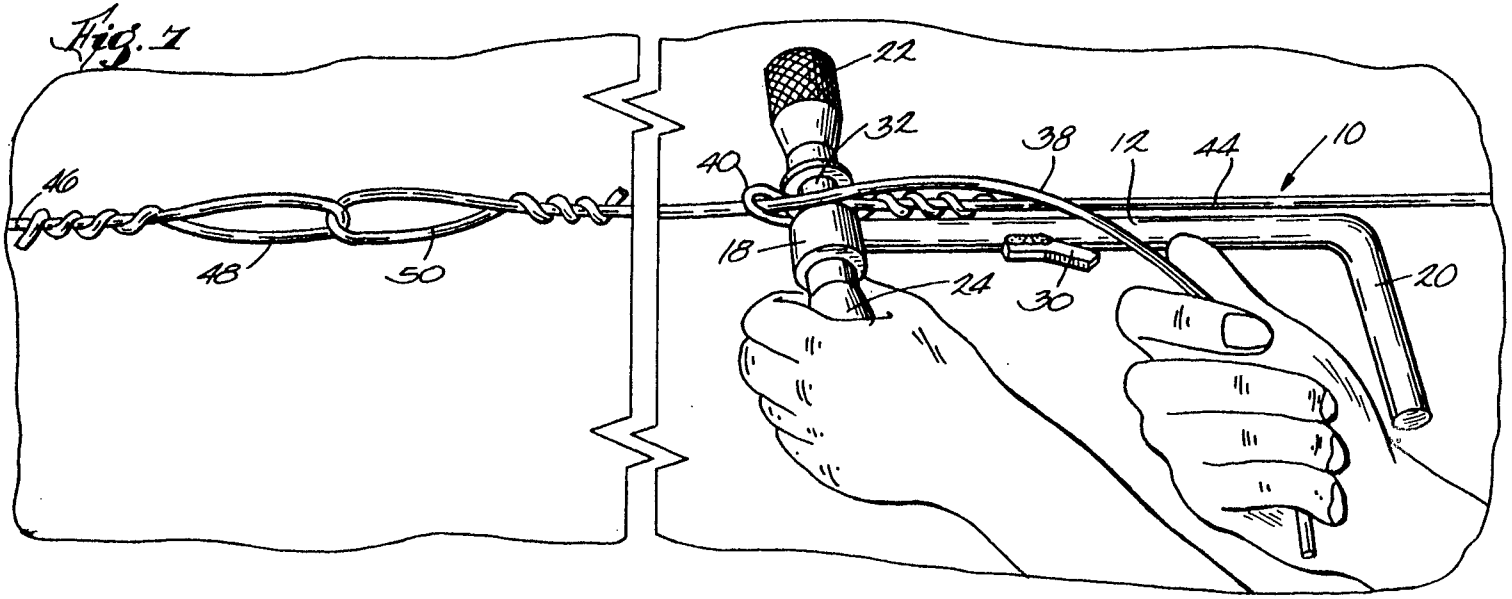

The user positions the tool 10, holding it by the pulling bar grip 24 (see FIG. 7). The user lays the loop 40 and the splice wire 38 passing through it against the wrapping surface 32 of the tool 10, securing the splice wire 38 with the cleat 30 (see FIG. 8). This connects the tool 10 to the link.

Figure 10:
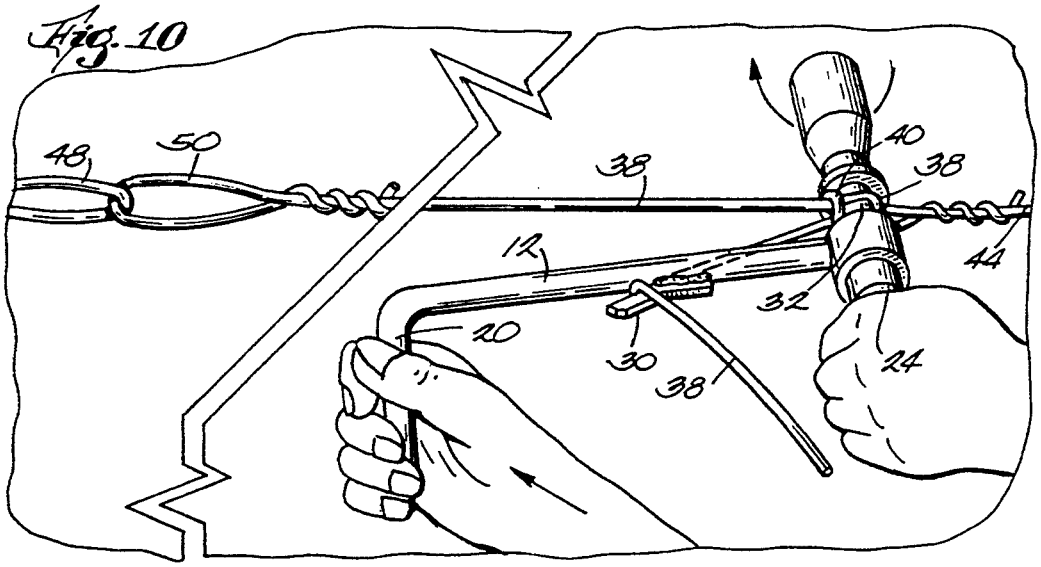

The user manipulates the tool 10 by applying force to the crank 20 (see FIG. 10). The crank 20 applies a mechanical advantage to rotate the tool body 12 about the pulling bar axis 26. This, in turn, rotates the wire wrapping surface 32.

The attached splice wire 38 (serving as the extension of the first length of wire) winds through the loop 40 and about the wrapping surface 32. This applies tension to the link.

Upon achieving the desired degree of tension, the user switches his/her grip on the tool 10. The user now holds the tool 10 with both hands on the pulling bar grips 22 and 24 (see FIG. 11). By pulling back on the tool 10 laterally across the rotational axis 26 of the wrapping surface 32, the user forms a bend 42 in the splice wire 38 next to the loop 40. The bend 42 holds the applied tension while the user rotates the wire wrapping surface 32 to unwind the wrapped splice wire 38 and release the tool 10 (see FIGS. 13 and 14).

Figure 15:
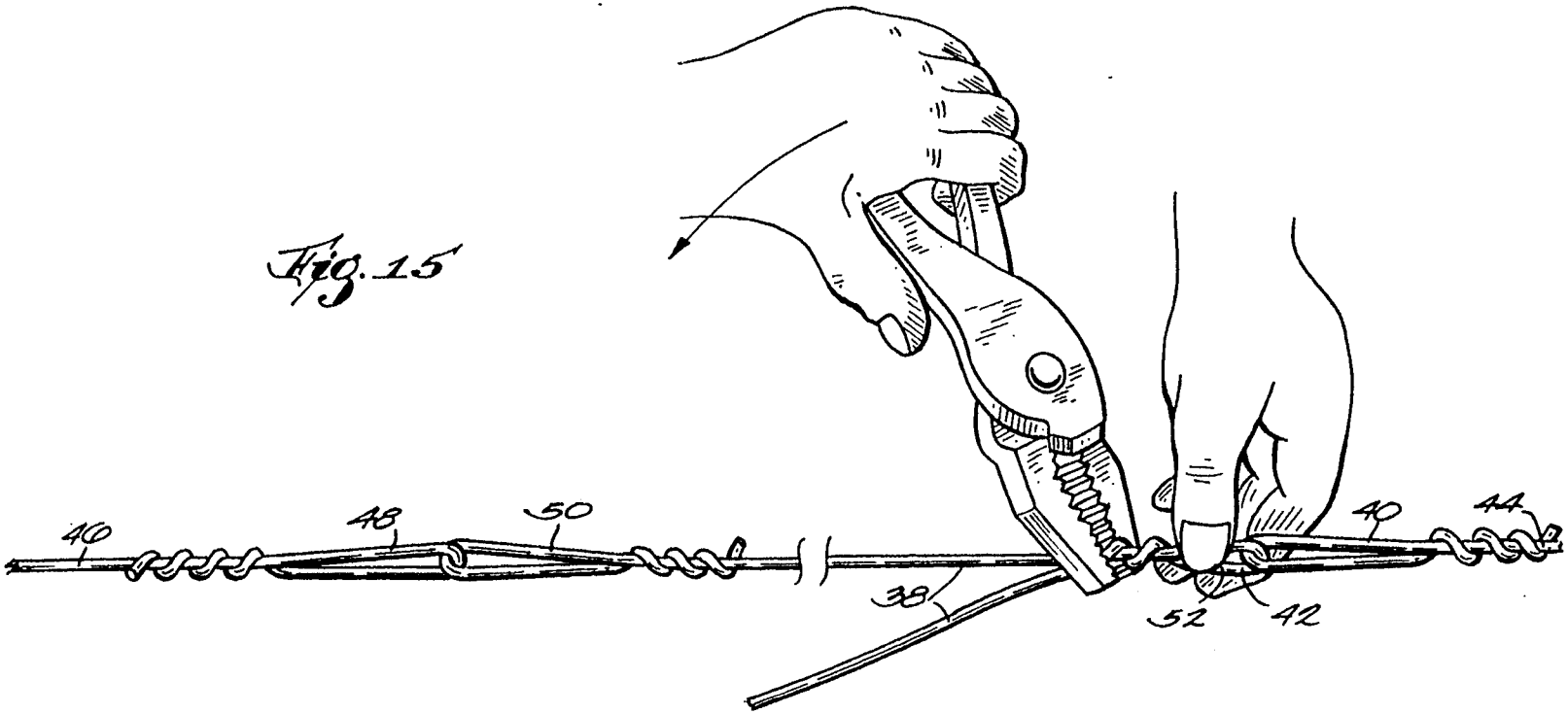

The user then secures the link (see FIG. 15).

According to the invention, the tensioned splice wire 38 unwinds from the tool 10 without releasing any of the applied tension. The result is a tensioned splice without slack or sag.

The following further describes the particular details of the method that embodies the features of the invention.

FIG. 2 shows a broken fence wire. The broken wire comprises a right portion 44 and a left portion 46.

First, as FIGS. 3 and 4 show, the user forms an eye or closed loop 40 and 48 in the ends of each parted wire portions 44 and 46. While not shown, the user preferably employs pliers to form the eyes 40 and 48.

Figure 5:
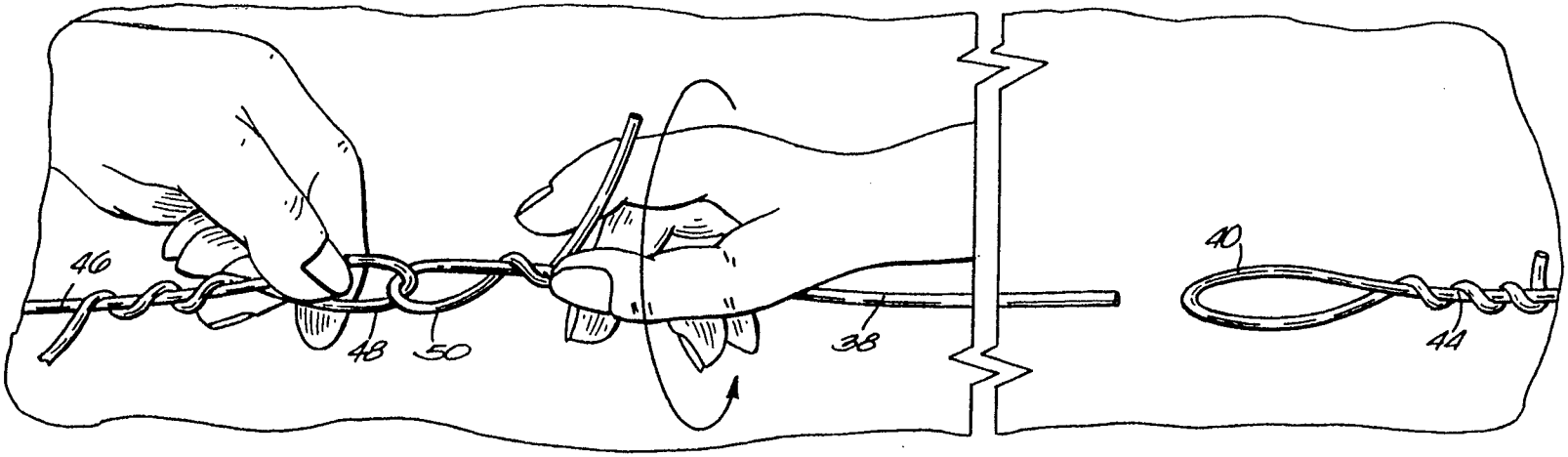

Next, as FIG. 5 shows, the user attaches a length of splice wire 38 to one of the eyes. In FIG. 5, the user loops the splice wire 38 through the left eye 48, and forms an eye 50 in the splice wire 38 to secure the attachment. Again, while not shown, the user preferably employs pliers in forming the splice wire eye 50.

Next, as FIG. 6 shows, the user draws the opposite end of the splice wire 38 through the already formed right eye 40 of the parted wire 44. In FIG. 6, the user draws the splice wire 38 in through the bottom of the loop 40. Still, the user can draw the splice wire 38 in through the top of the loop 40. The method and tools that embody the features of the invention do not require the user to remember and abide by exacting manipulative details.

As FIG. 7 shows, the user pulls on the splice wire 38 with one hand while inserting the tool 10, which the user holds by the bar grip 24 in the other hand. FIG. 7 shows the user on one side of the fence wires. The user also can stand on the opposite side of the wires and perform the same operation. The method and tools that embody the features of the invention are flexible and insensitive to the user's position about the fence being repaired.

As FIG. 7 shows, the user nests the junction of the splice wire 38 and right eye 40 against the wrapping surface 32. When the splice wire 38 passes through the bottom of the loop 40 (as FIG. 7 shows), the right eye 40 extends over the bottom of the wrapping surface 32 (i.e., the side facing the ground). The splice wire 38 extends over the top and onto the wrapping surface 32. However, when the user passes the splice wire 38 through the top of the loop 40, an opposite orientation on the wrapping surface 32 will result.

Figure 8:
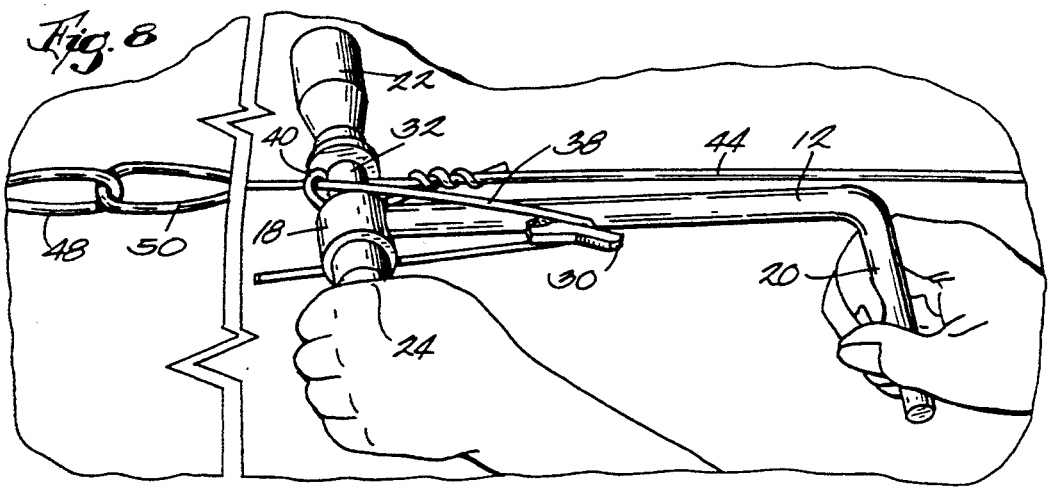
Figure 9:
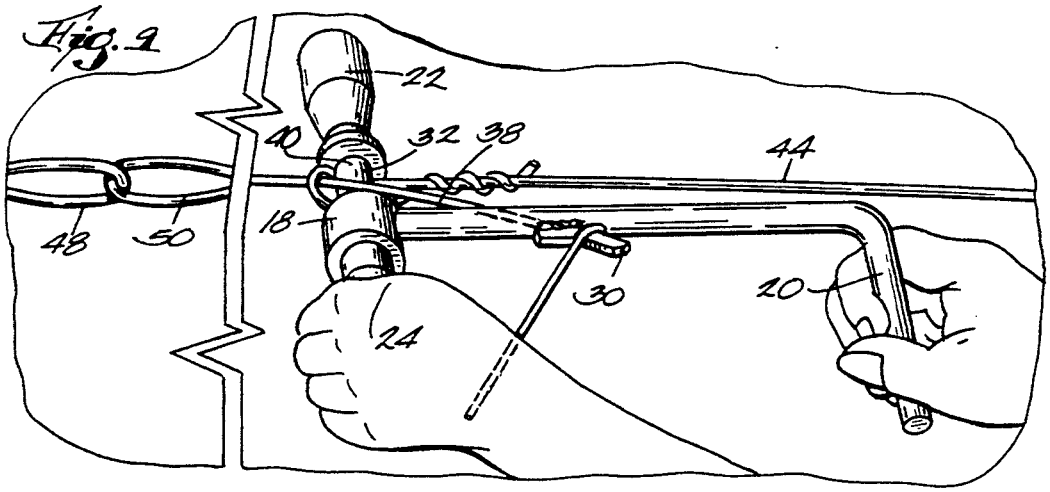

As FIG. 8 shows, the user next brings the free end of the splice wire 38 into engagement with the cleat 30. FIG. 8 shows the free end passing directly from the top of the wrapping surface 32 to the cleat 30. FIG. 9 shows an alternative way, in which the free end passes from the top of the wrapping surface 32, beneath the tool body 12, and then to the cleat 30. Either path secures the wire 38 for splicing.

As FIGS. 8 and 9 show, the user now holds the tool 10, with one hand (the left hand in the Figures) on the pulling bar grip 24 and the other (the right hand in the Figures) on the crank 20. It is now time to apply tension to the splice.

As FIG. 10 shows, the user applies tension by applying force to the crank 20. This rotates the tool body 12 about the axis 26 of the pulling bar 18, rotating the wire wrapping surface 32 about the same axis 26.

FIG. 10 shows the user holding the crank 20 in one hand while the other hand holds the grip 24 stationary. However, the tension in the linked wires alone will normally hold the tool 10 in place. The user does not have to hold the grip 24 while applying force to the crank 20. One hand on the crank 20 is all that is needed to rotate the tool 10.

According to the invention, the user rotates the tool 10 so that the splice wire 38 is pulled through the loop 40 and onto the wrapping surface 32. The actual direction of rotation that achieves this result will depend upon (i) whether the user is splicing the left wire to the right wire (as the Figures show), or vice versa; (ii) whether the user passes the splice wire 38 through the bottom of the loop 40 (as the Figures show), or through the top of the loop 40; and (iii) on what side of the fence the user stands. As long as the user rotates the tool 10 so that the splice wire 38 is pulled through the loop 40 and onto the wrapping surface 32, the user will derive the benefits of the invention.

In the: embodiment shown in FIG. 10, the user rotates the crank 20 clockwise to achieve this result. This rotation progressively pulls the splice wire 38 through the loop 40, winding it about the wrapping surface 32.

The rotation pulls the left parted wire 46 toward the right parted wire 44, placing the splice wire 38, and, with it, the left and right parted wires 44 and 46, into tension.

The user continues to rotate the crank 20 in this manner until the desired degree of tension is reached. The user must exercise care and judgment at this point, because rotation of the tool 10 will quickly develop tension sufficient to break even the strongest of fence wire.

Figure 11:
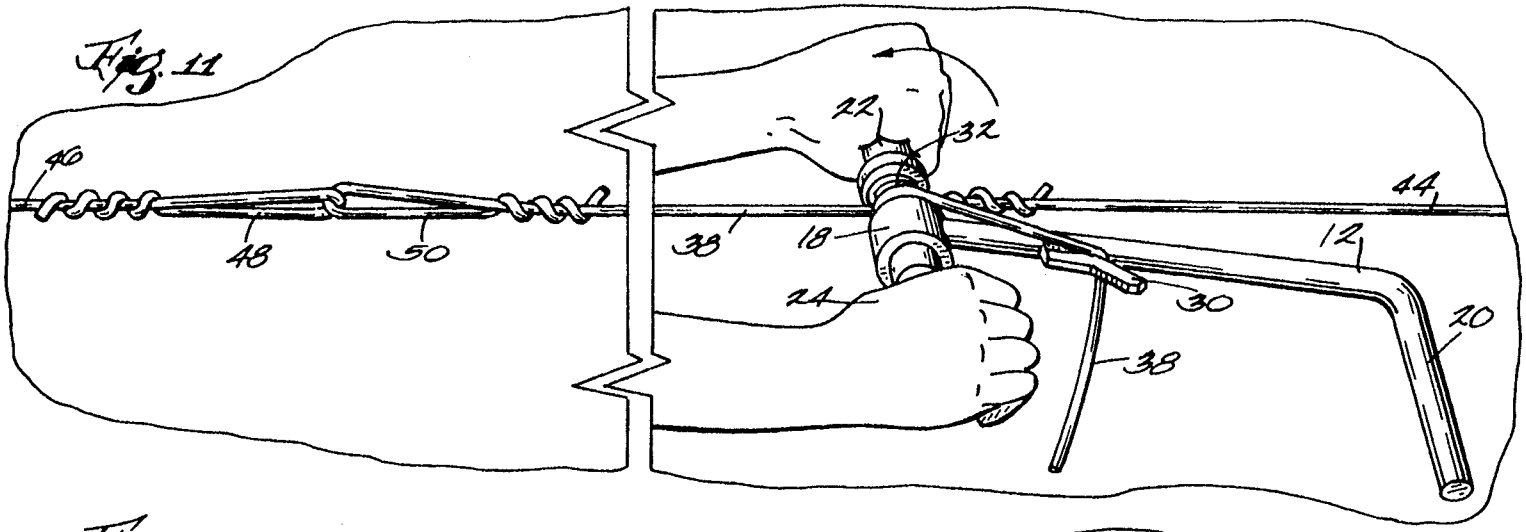

As a comparison of FIGS. 10 and 11 show, the tension that the tool 10 generates cases the eyes 48 and 50 joining the left parted wire 46 and the splice wire 38 to flatten out. This provides a good visual indication to the user when enough tension is present.

It is now time to release the tool 10 and complete the splice. As FIG. 11 shows, to accomplish this, the user changes his/her grip on the tool 10. The user now holds the tool 10 with both hands on the pulling bar grips 22 and 24. Maintaining this grip, the user pulls back on the tool 10, across the rotational axis 26 of the wrapping surface 32, away from the loop 40 (i.e., in the direction of the left parted wire 46).

Figure 12:
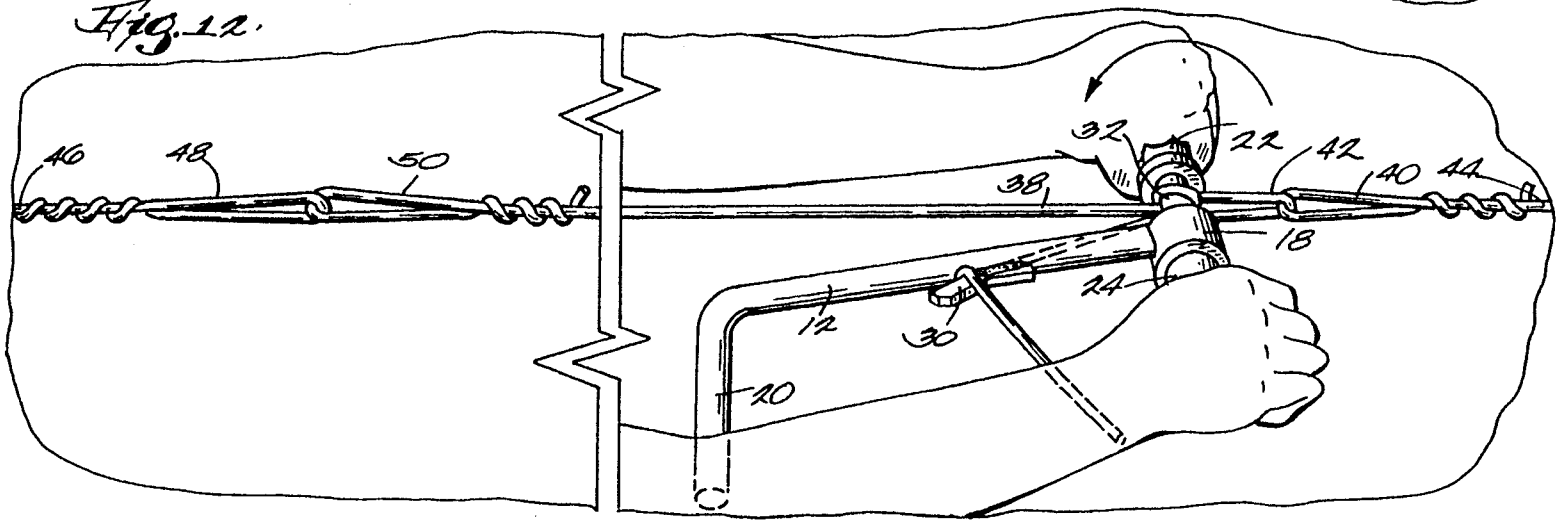

As FIGS. 11 and 12 show, while pulling back on the tool 10 in the manner just described, the tool will rotate counterclockwise. Again, the actual direction of rotation will depend whether the user splices left to right or right to left; whether the user threads the loop 40 through the top or through the bottom; and on what side of the fence the user stands.

The wrapped splice wire 38 unwinds from the wrapping surface 32 in the direction of the tension, doubling back upon itself. In doubling back, the splice wire 38 forms a bend 42 next to the right eye 40 (see FIG. 12).

Figure 13:
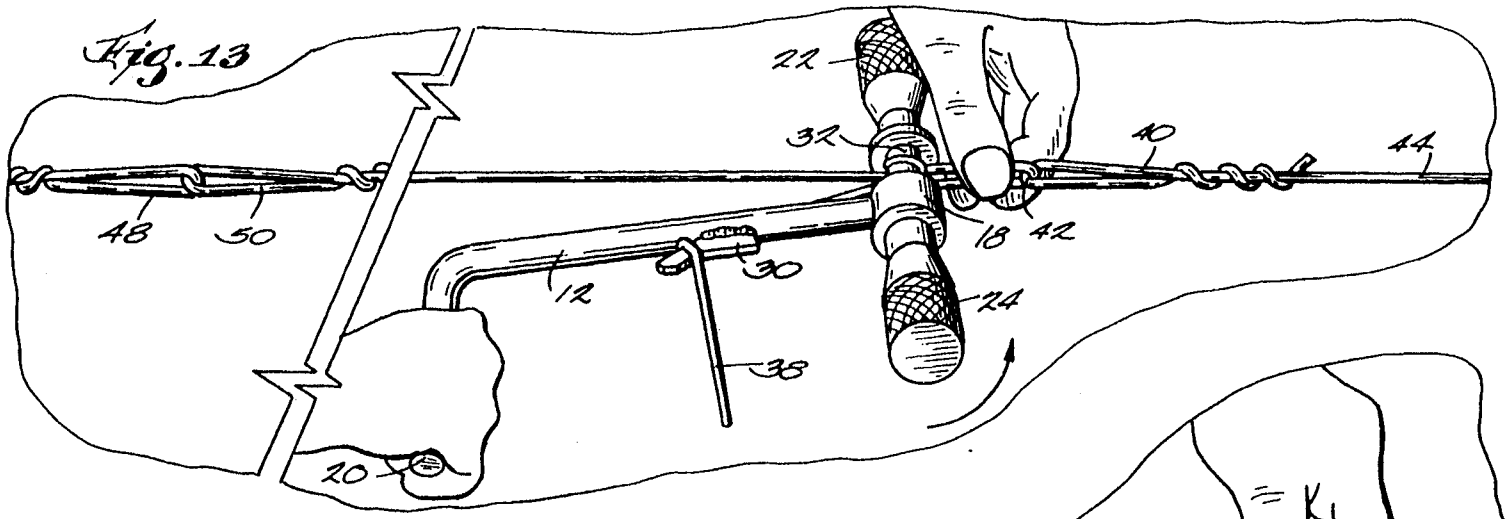

As FIGS. 12 and 13 show, the formed bend 42 holds the tension in the splice wire 38 as the user further rotates the tool 10 counterclockwise, further unwinding the splice wire 38 from the wrapping surface 32. In time, the free end of the splice wire 38 is presented for release from the cleat 30 (see FIG. 13).

Figure 14:
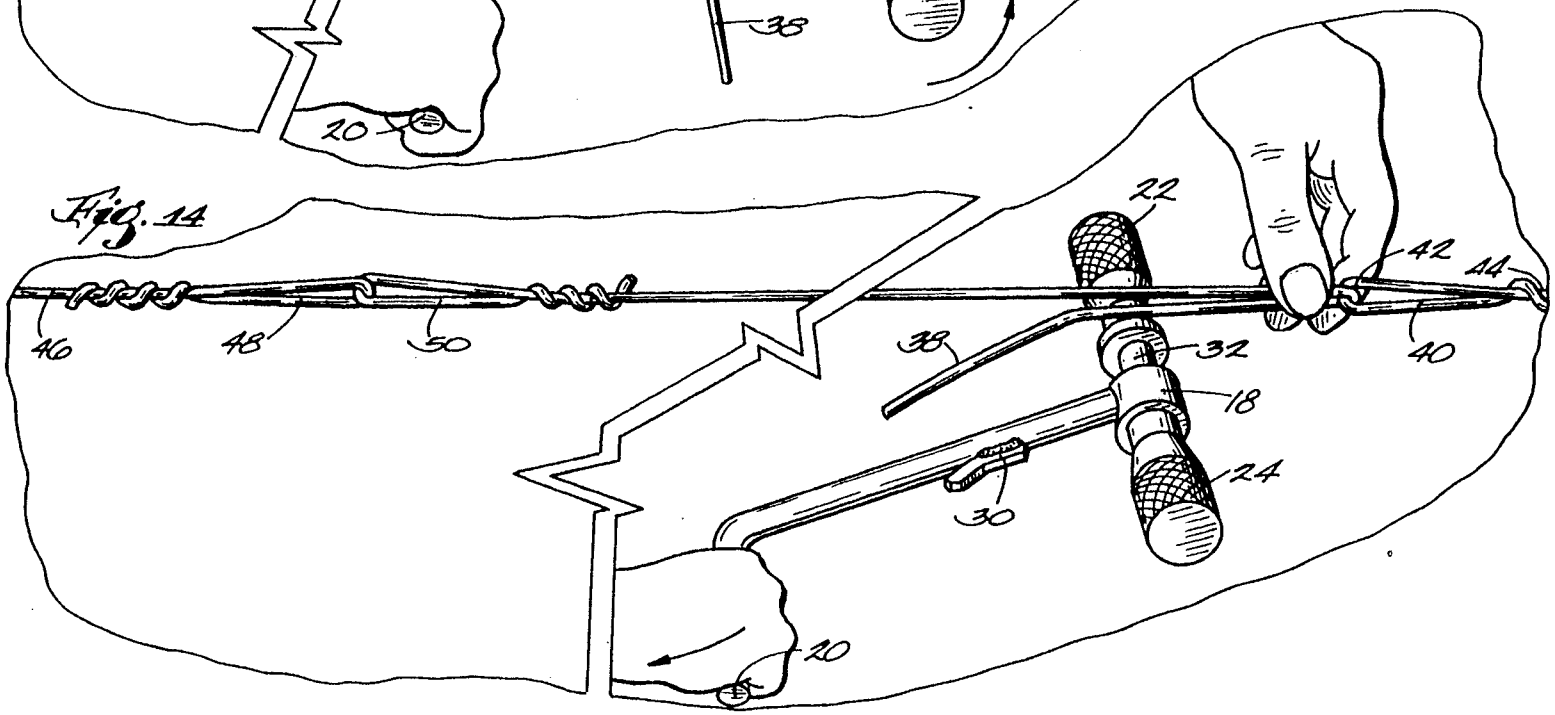

As FIGS. 13 and 14 show, the user holds the bend 42 with one hand (left hand) while holding the crank 20 with the other hand (right hand). While holding the bend 42, the user manipulates the crank 20 to completely free the tool 10 from the splice wire 38 (as FIG. 14 shows).

According to the invention, simply by applying finger pressure of one hand to the bend 42, the user can effectively hold all the tension applied to the splice wire 38 while releasing the tool 10.

Figure 16:
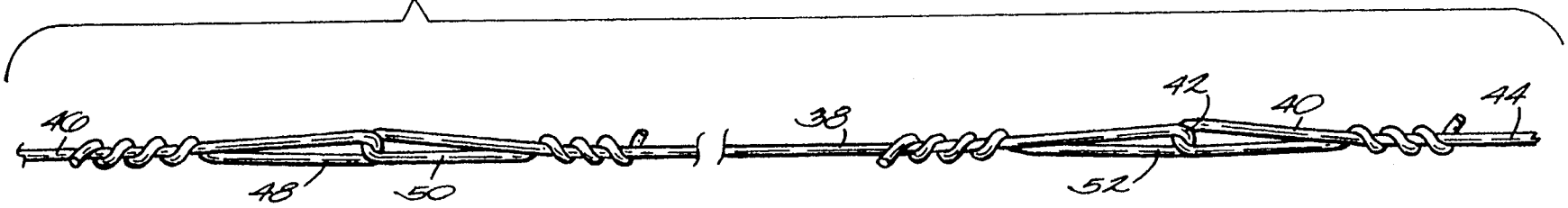

As FIG. 15 shows, with the tool 10 freed, the user forms an eye 52 to close the bend 42 of the splice wire 38, preferably using pliers. This completes the formation of the splice (as FIG. 16 shows).

Figures 17, 18, 19:
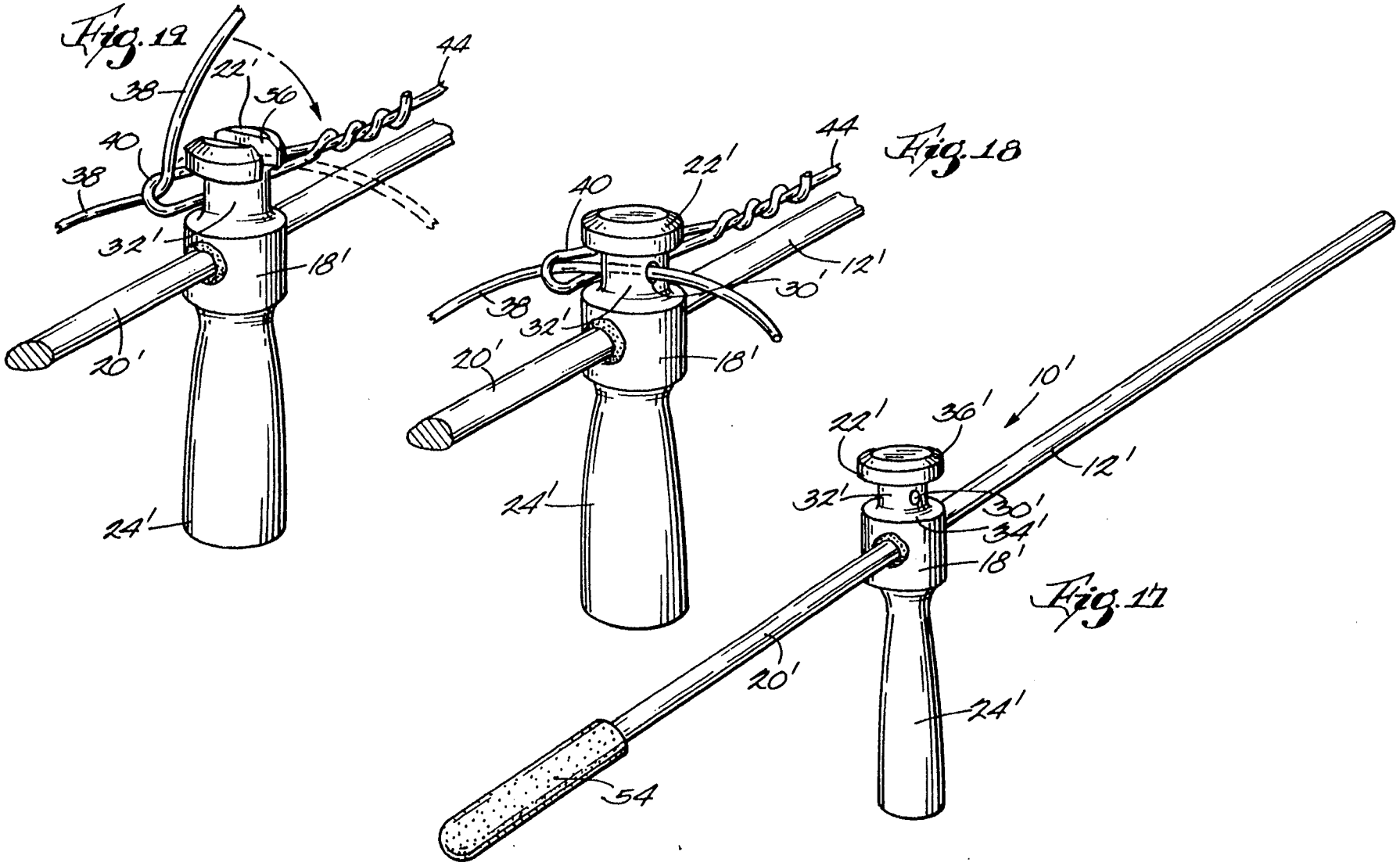
FIG. 17 is a perspective view of an alternative embodiment of a tool that embodies the features of the invention.
FIG. 18 is an enlarged perspective view of one embodiment of a wire splicing surface that embodies the features of the invention.
FIG. 19 is an enlarged perspective view of another embodiment of a wire splicing surface that embodies the features of the invention.

The wire splicing tool that embodies the features of the invention can take various forms. FIG. 17 shows one alternative embodiment.

In FIG. 17, the tool 10' includes a body that carries a wire splicing element 14' and a handle element 16', just like the tool 10 shown in FIG. 1 In FIG. 17, the handle element 16' includes a pulling bar 18'0 and a crank 20' In the FIG. 17 tool 10', unlike the FIG. 1 tool, the axes 26' and 28' of the pulling bar 18' and the crank 20' are generally perpendicular to each other. In this arrangement, the pulling bar 18' extends transversely across the middle of the tool body 12'. The crank 20' extends from opposite sides of the pulling bar 18', forming a generally cross-shaped structure. The crank 20' carries a gripping surface 54.

In FIG. 17, the wire splicing element 14' includes a wire gripping surface 30' and a wire wrapping surface 32'. Like the FIG. 1 tool 10, a portion of the pulling bar 18' comprises the wire wrapping surface 32'. As in the FIG. 1 embodiment, the wrapping surface 32' extends between the two collars 34' and 36' about the axis 26' of the pulling bar 18'.

The collars 34' and 36' also define the limits of the wrapping surface 32'. The first collar 34' is formed at the junction of the pulling bar 18' with the tool body 12'. The second collar 36' is formed at one end of the pulling bar 18'. A pulling grip 24' is formed at the opposite end of the pulling bar 18'. The second collar 36' itself forms the other pulling grip 22'.

In the embodiment shown in FIG. 17, the wire gripping surface 30' comprises a passage near the wrapping surface 32'. As shown, the passage 30' extends through the pulling bar 18. However, the passage 30' could be drilled in either collar 34' or 36', or elsewhere on the body 12' near the wrapping surface 32'.

As FIG. 18 shows, the user nests the junction of the splice wire 38 and right eye 40 against the underside of the wrapping surface 32' (i.e., the side facing the ground). The free end of the splice wire 38 extends through the right bye 40 and into the gripping passage 30'.

FIG. 19 shows a further variation in the wire gripping surface 30'. Here, the gripping surface comprises a slot formed 56 in the pulling bar 18'. As FIG. 19 shows, the user nests the junction of the splice wire 38 and right eye against the underside of the wrapping surface 32' (i.e., the side facing the ground). The free end of the splice wire 38 extends through the right eye 40 and into the slot 56. The loop 40 still extends forward of the wrapping surface 32'.

The user manipulates the tools 10' shown in FIGS. 17 to 19 in the same way as previously described and with the same results. The user forms the eyes in the parted left and right wires and attaches the splice wire 38 (as FIGS. 3 to 6 show). The user lays the right eye 40 and splice wire 38 against the wrapping surface 32' and engages the splice wire 38 in the gripping surface 30' or 56 (as FIGS. 18 and 19 show).

The user then holds the crank gripping surface 54 in one hand, while holding the presented pulling grip 24' with the other. The user applies a clockwise force to the crank 20' holding the grip 24' stationary, to rotate the wrapping surface 32' and wind the splice wire 38 through the loop 40 onto the wrapping surface 32'. The results are exactly as previously described and shown in FIGS. 9 and 10.

To release the tool 10' shown in FIG. 17, the user holds the tool by the pulling grips 22' and 24' The user pulls back upon the grips 22' and 24', across the rotational axis 26' of the wrapping surface 32', to form the tension-holding bend 42. Further counterclockwise rotation of tool frees the splice wire 38, while the user manually retains the bend 42. With the tool 10' freed, the user secures the bend 42. The results are exactly as previously described and shown in FIGS. 11 to 14.

Using the splicing method and tools that embody the features of the invention, one person alone can quickly and efficiently mend a parted fence wire. Not only that, using the tool, one person alone can return all the tension to the fence wire and hold that tension, without slackening, while the tool is released.

Using the splicing method and tools that embody the features of the invention, the user does not have to follow a rigorous, inflexible routine. The user is free to link the wires and connect the tool 10 in as many as eight different ways, allowing him/her to splice wires from left to right and right to left; to thread the loop link either through the top or through the bottom; and to stand on either side of the fence. The method and tools will work in equally efficient manner despite these manipulative variations. With such flexibility, the user controls the method and tools, and not vice versa.

Various features of the invention are set forth in the following claims.

We claim:

1. A tool for splicing wire comprising an elongated body, a splicing surface having an axis transverse to the elongated body for releasably holding a splice wire wound upon the splicing surface in response to rotation of the splicing surface about its axis, a wire holding slot positioned on said elongated body spaced from said splicing surface, a crank handle attached to the end of the elongated body opposite said splicing surface for rotating the splicing surface about its axis, and pulling handles adjacent said splicing surface said handles extending transversely from opposite sides of said elongated body for pulling laterally upon the splicing surface generally across its axis.

2. A tool according to claim 1 wherein the elongated body has opposite end portions, and wherein the crank handle is located near one body end portion and the pulling handles are located near the opposite body end portion.

3. A tool according to claim 2 wherein the splicing surface forms a part of the pulling handle.

4. A tool according to claim 1 wherein the splice wire holding is formed by a cleat positioned on the elongated body closer to the splicing surface than to the crank.

5. A tool according to claim 1 wherein the pulling handle includes at least one grip for a user to hold in pulling laterally upon the splicing surface.

6. A tool according to claim 5 wherein the grip includes a knurled surface area.

7. A tool for splicing wire comprising a splicing surface having an axis for releasably holding a splice wire wound upon the splicing surface during rotation of the splicing surface about its axis, an elongated handle extending generally transversely from the splicing surface for grasping to apply a force that rotates the splicing surface about its axis, a pair of pulling handles extending outwardly beyond axially opposite sides of the splicing surface and including grips spaced away from the splicing surface for simultaneous grasping to apply a force that laterally moves the splicing surface generally across its axis, and a wire holding slot spaced away from both pulling handle grips.

8. A tool according to claim 7 and further including a crank handle attached to the elongated handle at a location also spaced away from the pulling handle grips.

9. A tool according to claim 7 wherein the pulling handle grips are knurled.

* * * * *